US007867011B2

(12) United States Patent
Kato

(10) Patent No.: US 7,867,011 B2
(45) Date of Patent: Jan. 11, 2011

(54) CONNECTOR ASSEMBLY

(75) Inventor: Rintaro Kato, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 12/321,171

(22) Filed: Jan. 16, 2009

(65) Prior Publication Data

US 2009/0186514 A1 Jul. 23, 2009

(30) Foreign Application Priority Data

Jan. 16, 2008 (JP) ..... 2008-006763

(51) Int. Cl.
*H01R 13/62* (2006.01)

(52) U.S. Cl. ..... 439/372; 439/352

(58) Field of Classification Search ..... 439/92, 439/95, 350–358, 372, 607
See application file for complete search history.

(56) References Cited

U.S. PATENT DOCUMENTS

| | | | | |
|---|---|---|---|---|
| 5,915,987 | A * | 6/1999 | Reed et al. | 439/352 |
| 6,488,524 | B2 * | 12/2002 | Endo | 439/353 |
| 6,902,432 | B2 * | 6/2005 | Morikawa et al. | 439/607.41 |
| 6,948,958 | B1 * | 9/2005 | Kikuchi et al. | 439/157 |
| 7,040,910 | B2 * | 5/2006 | Nagata et al. | 439/352 |
| 7,128,595 | B2 * | 10/2006 | Boutros | 439/358 |
| 7,134,912 | B2 | 11/2006 | Kamata et al. | |
| 2005/0208802 | A1 | 9/2005 | Kikuchi et al. | |

FOREIGN PATENT DOCUMENTS

| | | |
|---|---|---|
| JP | 08-315911 | 11/1996 |
| JP | 2004-327168 | 11/2004 |
| JP | 2005-267977 | 9/2005 |
| JP | 2005-332749 | 12/2005 |
| JP | 20070234491 | 9/2007 |
| KR | 10-0794733 | 1/2008 |

OTHER PUBLICATIONS

Japanese Office Action dated Dec. 10, 2009 with an English translation of same.
Korean Office Action dated Sep. 29, 2010 in Korean Application No. 10-2009-0003377.
Korean Office Action dated Sep. 29, 2010 in Korean Application No. 10-2009-0003377, (with English language translation).

* cited by examiner

*Primary Examiner*—Thanh-Tam T Le
(74) *Attorney, Agent, or Firm*—Collard & Roe, P.C.

(57) ABSTRACT

A connector assembly is disclosed, comprising a first connector and a second connector matable with each other along a first direction. The first connector comprises a first insulator and first lock portions. The first lock portions are made of metal and are attached to the first insulator. Each of the first lock portions is formed with an engaged hole piercing the first lock portion in a second direction perpendicular to the first direction. The second connector comprises a second insulator and a second lock portion. The second lock portion is provided with engaging portions. The second insulator holds the second lock portion with the engaging portions movable along the second direction. The engaging portions of the second lock portion are positioned within the engaged portions of the first lock portions, respectively, under a mating state of the first connector with the second connector, so that the mating state is locked.

7 Claims, 7 Drawing Sheets

CONNECTOR ASSEMBLY

CROSS REFERENCE TO RELATED APPLICATIONS

An applicant claims priority under 35 U.S.C. §119 of Japanese Application No. JP2008-006763 filed Jan. 16, 2008.

BACKGROUND OF THE INVENTION

This invention relates to a connector assembly which comprises connectors matable with each other and is provided with a lock mechanism for locking a mating state of the connectors.

A connector assembly of type is disclosed in JP-A 2005-267977, the contents of which are incorporated herein by reference. The disclosed connector assembly comprises a plug connector and a receptacle connector. The receptacle connector is mounted and fixed on a circuit board and is provided with engaged portions. The plug connector is matable with or detachable from the receptacle connector. The plug connector comprises an angular C-shaped pull bar. Under the mating state of the plug connector with the receptacle connector, tips of the pull bar are engaged with the engaged portions of the receptacle connector so that the mating state is locked. When the pull bar is raised, the tips of the pull bar are disengaged from the engaged portions of the receptacle connector; when the pull bar is then pulled, the plug connector is detached form the receptacle connector.

There is a need for a connector assembly which comprises a reliable lock mechanism for locking a mating state of connectors. However, it is difficult to form a reliable lock mechanism in the disclosed connector assembly without making the size of the connector assembly large.

SUMMARY OF THE INVENTION

It is an object of the present invention to provide a connector assembly which comprises a reliable lock mechanism with the size of the connector assembly kept small.

One aspect of the present invention provides a connector assembly comprising a first connector and a second connector. The first connector is matable with and detachable from the second connector along a first direction. The first connector comprises a first insulator and first lock portions. The first lock portions are made of metal and are attached to the first insulator. Each of the first lock portions is formed with an engaged hole. The engaged hole pierces the first lock portion in a second direction perpendicular to the first direction. The second connector comprises a second insulator and a second lock portion. The second lock portion is provided with engaging portions. The second insulator holds the second lock portion while the engaging portions are movable along the second direction. The engaging portions of the second lock portion are positioned within the engaged holes of the first lock portions, respectively, under a mating state of the first connector with the second connector, so that the mating state is locked.

An appreciation of the objectives of the present invention and a more complete understanding of its structure may be had by studying the following description of the preferred embodiment and by referring to the accompanying drawings.

Figure 1:
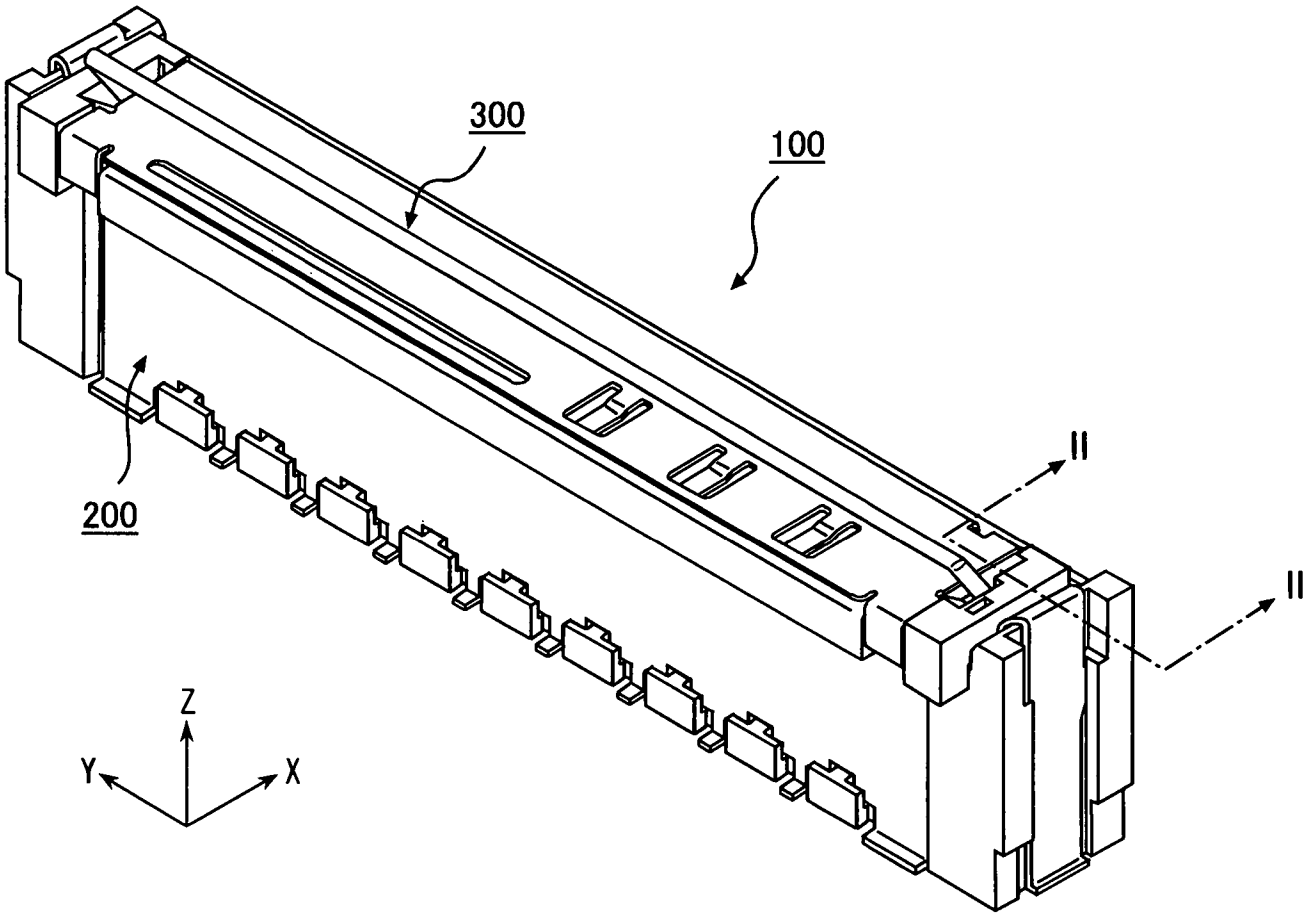
FIG. 1 is a perspective view showing a connector assembly which comprises a plug connector and a receptacle connector in accordance with an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 4:
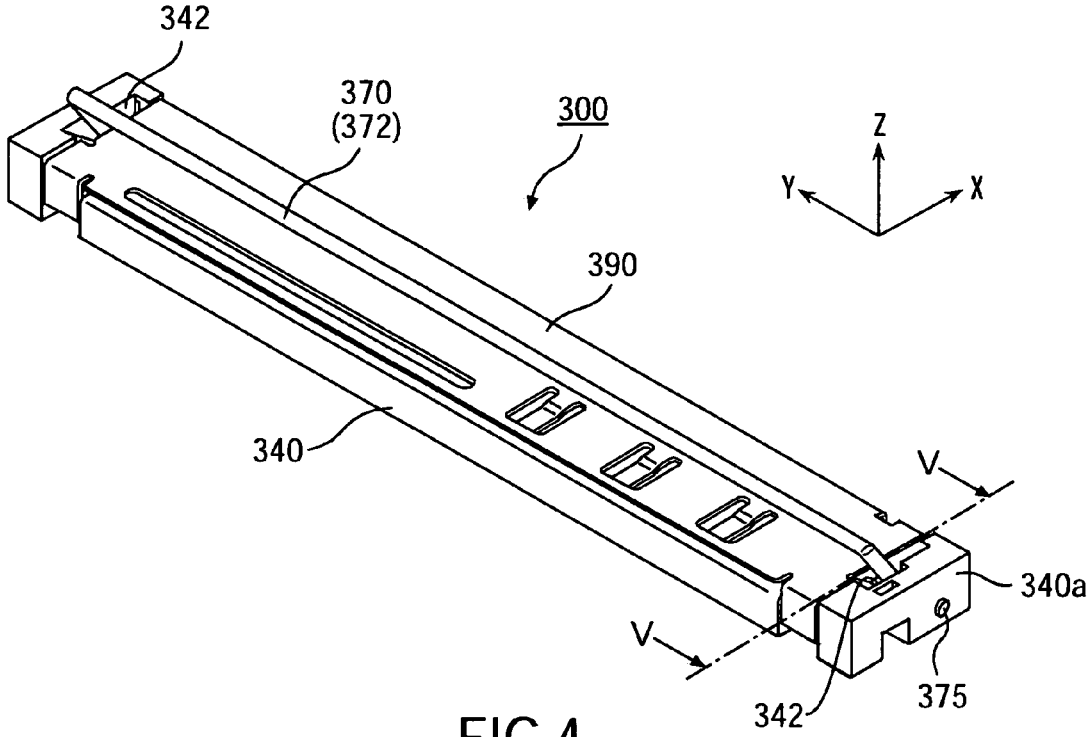
FIG. 4 is a perspective view showing the plug connector of FIG. 1.
Figure 8:
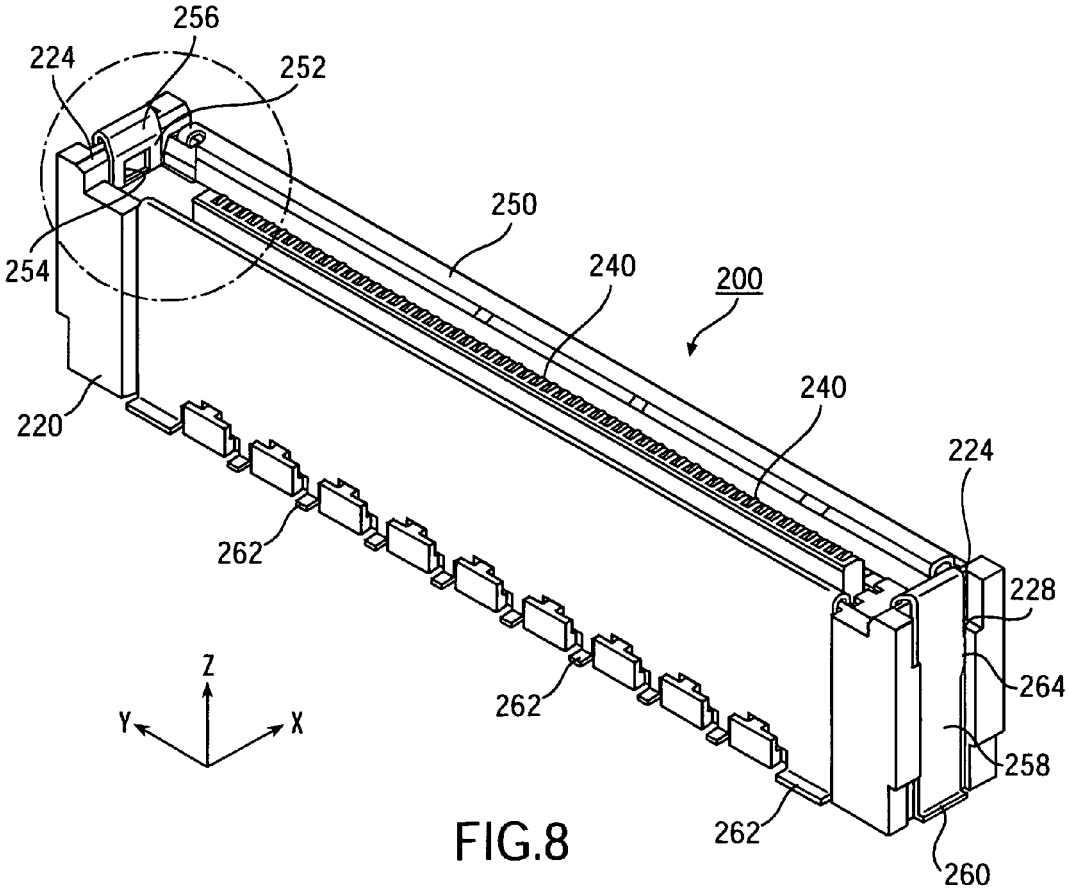
FIG. 8 is a perspective view showing the receptacle connector of FIG. 1.

With reference to FIGS. 1, 4 and 8, a connector assembly 100 according to an embodiment of the present invention comprises a first connector 200 and a second connector 300. In this embodiment, the first connector 200 is a receptacle connector which is to be mounted and fixed on a circuit board (not shown). The second connector 300 is a plug connector which is to be connected to, for example, a set of coaxial cables or a flexible flat cable. The first connector 200 is matable with and detachable from the second connector 300 along a Z-direction (first direction).

Figure 6:
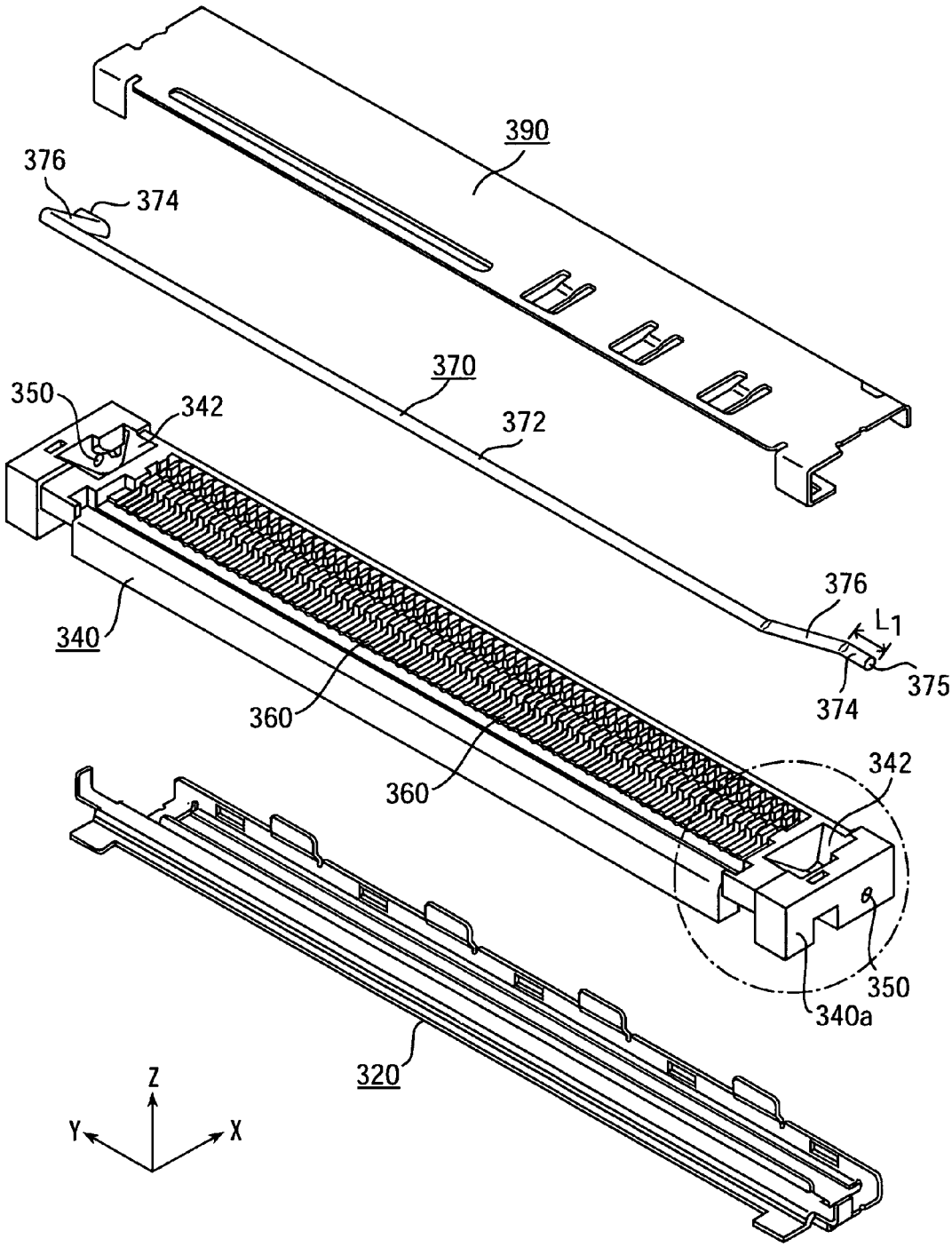
FIG. 6 is an exploded, perspective view showing the plug connector of FIG. 4.

With reference to FIGS. 4 and 6, the second connector 300 comprises a base shell 320, a second insulator 340, a plurality of contacts 360, a second lock portion 370 and a cover shell 390. The base shell 320 partially covers a bottom surface of the second insulator 340. The contacts 360 are held by the second insulator 340. The cover shell 390 covers a top surface of the second insulator 340.

As shown in FIG. 6, the second lock portion 370 is a pull bar made of metal. In detail, the second lock portion 370 has a crank-like shape obtainable by bending a single metal rod and comprises a main portion 372, held portions 374 and connection portions 376. The main portion 372 extends in a Y-direction (second direction), i.e. a longitudinal direction of the second connector 300. Each of the held portions 374 extends in the Y-direction and has a length $L_1$ in this embodiment. The connection portions 376 connect the main portion 372 and the held portions 374, respectively, so that the held portions 374 have outwardly-extending ends, respectively. The outwardly-extending ends of the held portions 374 serve as engaging portions 375, respectively.

As shown in FIGS. 4 to 7, the second insulator 340 has end portions 340*a* in the Y-direction. The second insulator 340 is formed with accommodation portions 342 and through-holes 350. Each of the accommodation portions 342 opens in the Z-direction so that the accommodation portions 342 can partially receive the respective connection portions 376 of the second lock portion 370 along the Z-direction.

Figure 7:
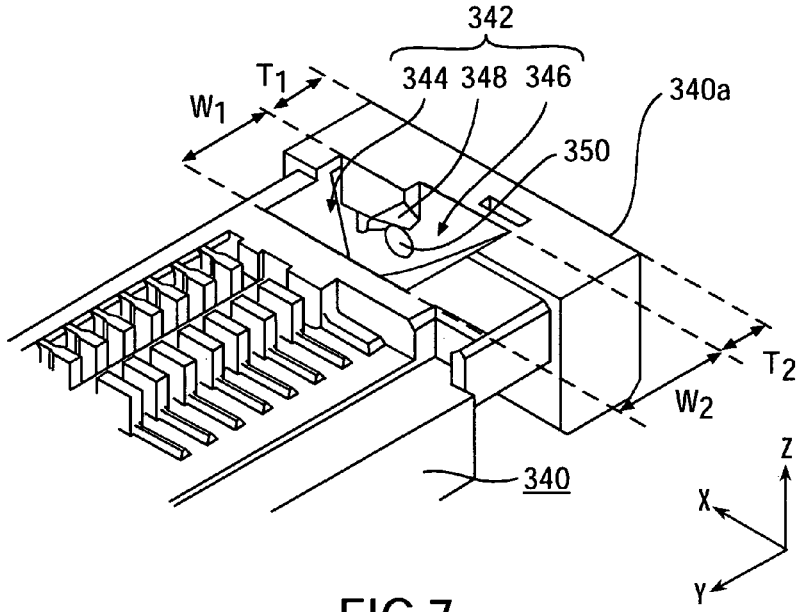
FIG. 7 is an enlarged, perspective view showing the plug connector of FIG. 6, encircled with a chain line. Contacts are not shown in the drawing.

As shown in FIG. 7, each of the accommodation portions 342 comprises a narrower portion 344, a wider portion 346 and a cam portion 348. The narrower portion 344 has a first width $W_1$ in the Y-direction. The second insulator 340 has a thickness $T_1$ between the narrower portion 344 and the end portion 340*a* of the second insulator 340. The wider portion 346 has a second width $W_2$ in the Y-direction. The second insulator 340 has a thickness $T_2$ between the wider portion 346 and the end portion 340*a* of the second insulator 340. The second width $W_2$ is wider than the first width $W_1$. The thickness $T_2$ is thinner than the thickness $T_1$. The first width $W_1$ is smaller than the length $L_1$ of the held portion 374 of the second lock portion 370, while the second width $W_2$ is larger than the length $L_1$ of the held portion 374. The relation between the first width $W_1$ and the length $L_1$ can prevent the second lock portion 370 from undesirably coming off the second insulator 340 when the second lock portion 370 is pulled along the Z-direction. The relation between the second width $W_2$ and the length $L_1$ contributes easy assemblage of the second lock portion 370 and the second insulator 240. In addition, the thickness $T_1$ is larger than the length $L_1$, while the thickness $T_2$ is smaller than the length $L_1$. In a normal state where the second lock portion 370 is not operated, a part of the connection portion 376 is positioned within the wider portion 346. In other words, the wider portion 346 accommodates in part the connection portion 376 in the normal state.

Figure 5:
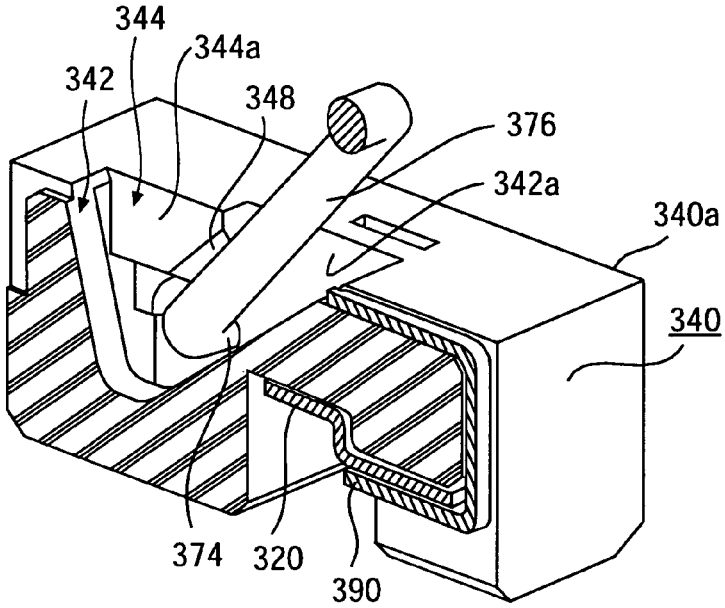
FIG. 5 is an enlarged, perspective, partially-cross-sectional view showing the plug connector of FIG. 4, taken along lines V-V.

With reference to FIGS. 5 and 7, the cam portion 348 is positioned between the narrower portion 344 and the wider portion 346. The cam portion 348 is formed on the inner wall 342*a* of the accommodation portion 342, wherein the inner wall 342*a* is a wall nearest to the end portion 340*a* of the second insulator 340 among all walls of the accommodation portion 342. The illustrated cam portion 348 has a surface oblique to all of the Z-direction, the Y-direction and an X-direction. When the second lock portion 370 is operated to rotate the held portion 374, the connection portion 376 follows the cam portion 348 so that the cam portion 348 forces the engaging portion 375 to move inward of the second insulator 340. In detail, when the connection portion 376 moves from the wider portion 346 to the narrower portion 344 in response to operation of the main portion 372, the cam portion 348 regulates the movement of the connection portion 376 and forces the engaging portion 375 to move inward.

Figure 2:
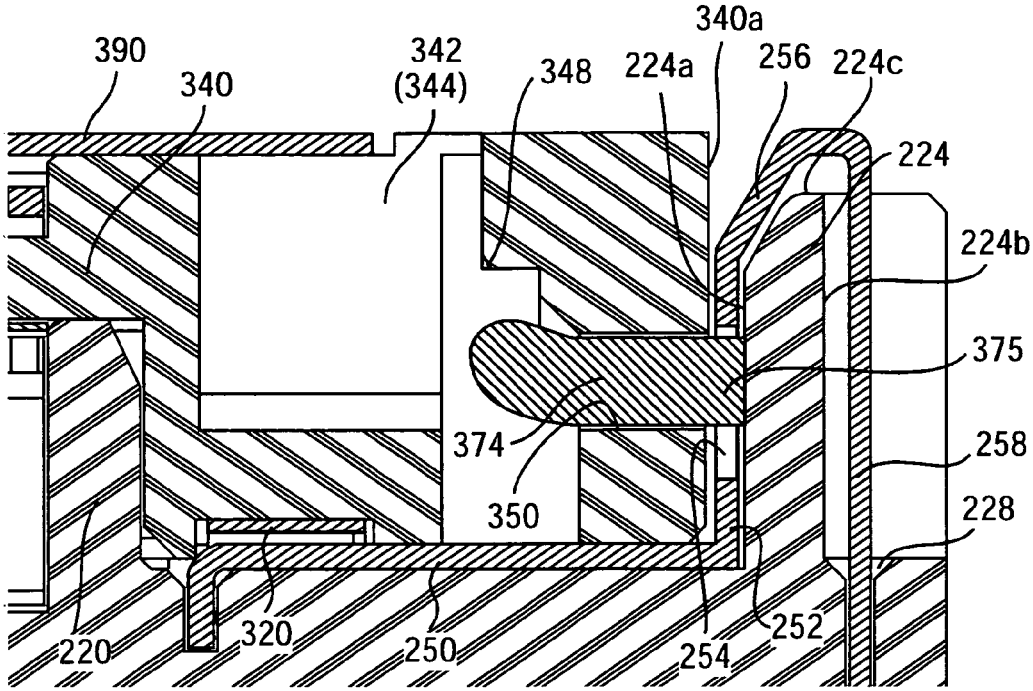
FIG. 2 is a partial, enlarged, cross-sectional view showing the connector assembly of FIG. 1, taken along lines II-II.

Each of the through-holes 350 extends between an inner wall 342*a* of the accommodation portion 342 and the end portion 340*a* of the second insulator 340 along the Y-direction so that the accommodation portion 342 communicates with the outside of the second insulator 340 through the through-hole 350. The through-holes 350 hold the held portions 374, respectively, so that the held portions 374 are rotatable in the through-holes 350 in response to operation of the main portion 372 and are movable only along the Y-direction. In the normal state, the outwardly-extending ends of the held portions 374, i.e. the engaging portions 375, project outwardly from the end portions 340*a* of the second insulator 340, respectively, as shown in FIGS. 2 and 4.

In this embodiment, the position of the accommodation portion 342 is determined in consideration of the length of the main portion 372 of the second lock portion 370 so that the connection portion 376 is brought into contact with the inner wall 342*a* within the wider portion 346. As explained above, the thickness $T_1$ is larger than the length $L_1$, while the thickness $T_2$ is smaller than the length $L_1$ in this embodiment. Therefore, the engaging portion 375 projects from the second insulator 340 under the normal state, while the engaging portion 375 is accommodated within the through-hole 350 when the connection portion 376 is positioned within the narrower portion 344. However, the present invention is not limited the present embodiment but allows another relation among the thickness $T_1$, the thickness $T_2$ and the length $L_1$, provided that the connection portion 376 is guided by the cam portion 348 when the second lock portion 370 is raised. In other words, in order to lead the cam portion 348 to function suitably, the accommodation portion 342 should be formed so that the connection portion 376 is positioned closer to the end portion 340*a* beyond a surface 344*a* of the narrower portion 344 under the normal state, as shown in FIG. 5.

Figure 10:
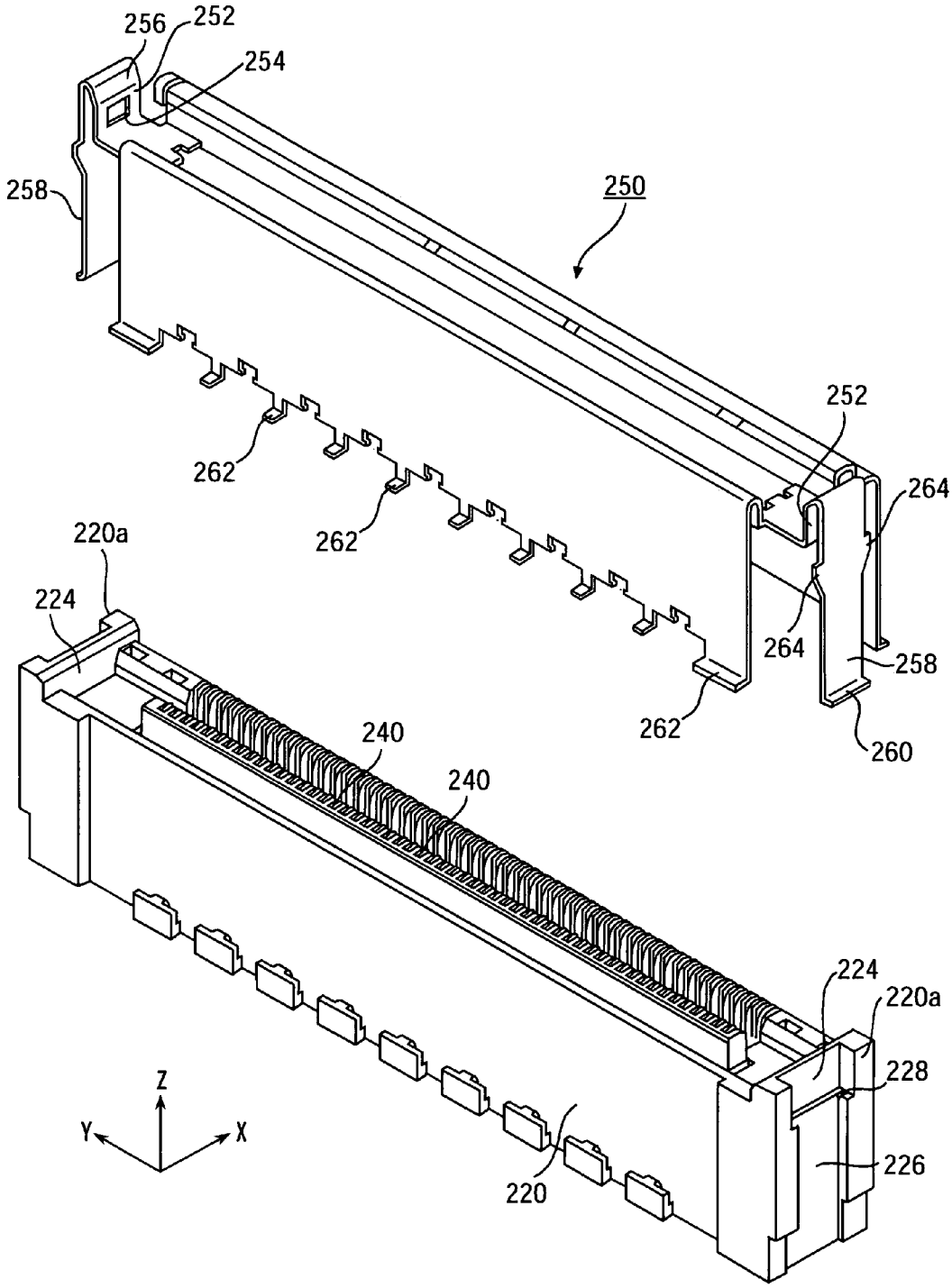
FIG. 10 is an exploded, perspective view showing the receptacle connector of FIG. 8.

With reference to FIGS. 8 and 10, the first connector 200 comprises a first insulator 220, a plurality of contacts 240, and a shell 250.

As shown in FIG. 10, the first insulator 220 holds the contacts 240. As understood from FIGS. 1 and 8, the first insulator 220 has sidewall portions 224 between which the second connector 300 is positioned in the Y-direction under the mating state of the first connector 200 with the second connector 300. As shown in FIG. 10, opposite end portions 220*a* of the first insulator 220 in the Y-direction are formed with wide recesses 226, respectively. Each of the wide recesses 226 has a wide width in the X-direction and extends in the Z-direction. Each wide recess 226 is provided with fitted portions 228, which are positioned under the sidewall portion 224.

Figure 9:
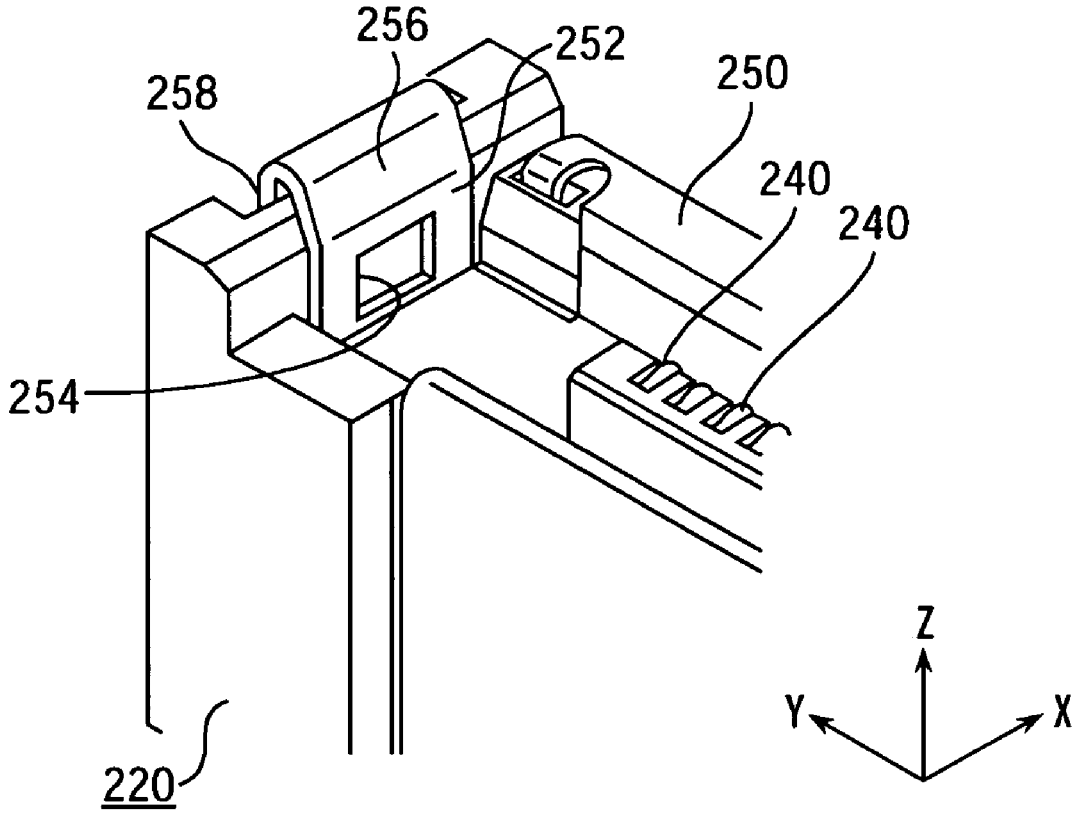
FIG. 9 is an enlarged, perspective view showing the receptacle connector of FIG. 8, encircled with a chain line.

With reference to FIGS. 8 to 10, the shell 250 is made of metal and generally covers the first insulator 220. The shell 250 is provided with first lock portions 252. The first lock portions 252 are arranged on inner surfaces 224*a* of the sidewall portions 224, respectively, as apparent from FIG. 2. Each of the first lock portions 252 is formed with an engaged hole 254, which piercing the first lock portion 252 in the Y-direction. The illustrated first lock portions 252 comprise guide portions 256, respectively. The guide portion 256 is positioned above the engaged hole 254 and is arranged oblique to both of the Y-direction and the Z-direction. The guide portion 256 guides the engaging portion 375 of the second lock portion 370 into the engaged hole 254 when the first connector 200 is mated with the second connector 300.

With reference to FIG. 2, the engaging portion 375 is positioned within the engaged hole 254 under the mating state. Even if a force is applied to the second connector 300 to undesirably detach the second connector 300 from the first connector 200 under the mating state, the engaging portion 375 is engaged with the edge of the engaged hole 254 so that the mating stated is locked. As explained above, the first lock portion 252 is made of metal so that the first lock portion 252 can make the locking of the mating state highly reliable.

Figure 3:
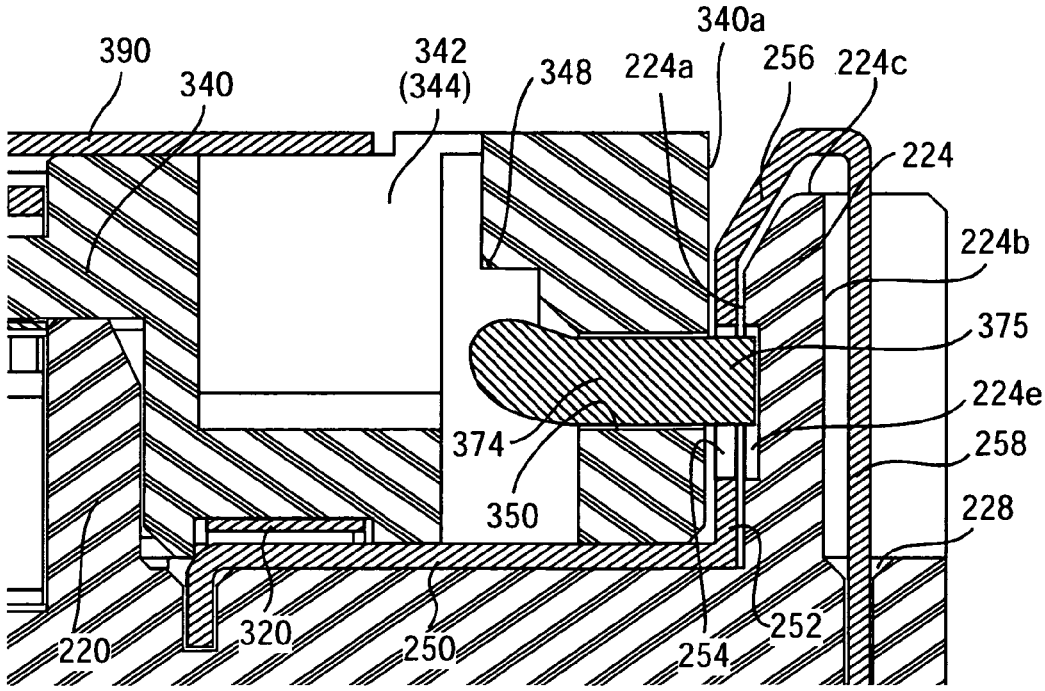
FIG. 3 is a partial, enlarged, cross-sectional view showing a modification of the connector assembly of FIG. 2.

The engagement of the engaging portion 375 and the engaged hole 254 may be modified. For example, each of the sidewall portions 224 may be further formed with an engaged depression 224*e*, as shown in FIG. 3. The engaged depression 224*e* is positioned in correspondence with the engaged hole 254 in the Y-direction. In this modification, the engaging portion 375 is inserted through the engaged hole 254 into the engaged depression 224*e* so that the mating state is more securely locked.

Turning back to FIGS. 8 to 10, the shell 250 is provided with fixed portions 258. As apparent from FIG. 2, the fixed portions 258 are connected to the first lock portions 252 at positions above top portions 224*c* of the sidewall portions 224, respectively. The connection between the first lock portion 252 and the fixed portion 258 has a U-like shape in a cross-section perpendicular to the X-direction. Each of the fixed portions 258 covers an outer surface 224*b* of the sidewall portion 224. In other words, the sidewall portion 224 is positioned between the first lock portion 252 and the fixed portion 258 in the Y-direction. As apparent from FIGS. 8 and 10, each of the fixed portions 258 is formed so that, when the first connector 200 is mounted on a circuit board, the fixed portion 258 extends to the circuit board and is fixed to the circuit board. The illustrated fixed portion 258 is formed with wing portions 264 and a soldered portion 260. The wing portions 264 extend in opposite orientations along the X-direction. The wing portions 264 are pressly-fitted into the fitted portions 228 of the first insulator 220, respectively, so that the fixed portion 258 is held by the wide recess 226. The soldered portion 260 is formed as an end portion of the fixed portion 258 in the Z-direction and is fixed on the circuit board by soldering. The shell 250 is further provided with soldered portions 262, which are fixed to the circuit board by soldering, similar to the soldered portion 260.

In this embodiment, the first lock portion 252 is positioned apart from the soldered portion 260 of the fixed portion 258 only by the thickness of the sidewall portion 224 in the Y-direction. In other words, the soldered portion 260 is positioned almost directly under the first lock portion 252. The arrangement of the solder portion 260 and the first lock portion 252 results in that the first lock portion 252 has a sufficient structural strength against a force directing upwards.

In order to detach the second connector 300 from the first connector 200, the second lock portion 370 is raised so that the connection portions 376 move into the narrower portions 344, respectively. The movement releases the locking of the mating state. Then, the raised second lock portion is pulled upwards so that the second connector 300 is detached from the first connector 200.

The present application is based on a Japanese patent application of JP2008-006763 filed before the Japan Patent Office on Jan. 16, 2008, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector assembly comprising a first connector and a second connector, the first connector being matable with and detachable from the second connector along a first direction, the first connector comprising a first insulator and first lock portions, the first lock portions being made of metal and being attached to the first insulator, each of the first lock portions being formed with an engaged hole, the engaged hole piercing the first lock portion in a second direction perpendicular to the first direction, the second connector comprising a second insulator and a second lock portion, the second lock portion being provided with engaging portions, the second insulator holding the second lock portion while the engaging portions being movable along the second direction, the engaging portions of the second lock portion being positioned within the engaged holes of the first lock portions, respectively, under a mating state of the first connector with the second connector, so that the mating state is locked, wherein the first insulator comprises sidewall portions in the second direction, the second connector being positioned between the sidewall portions in the second direction under the mating state, the sidewall portions having inner surfaces, respectively, the first lock portions being attached on the inner surfaces of the sidewall portions, respectively, wherein the sidewall portions are formed with engaged depressions, respectively, the engaged depressions being positioned in correspondence with the engaged holes in the second direction, respectively, the engaging portions of the second connector being inserted through the engaged holes into the engaged depressions, respectively, when the mating state is locked, wherein the second lock portion has a shape obtainable by bending a single metal rod and comprises a main portion, held portions and connection portions, the main portion extending in the second direction, each of the held portions extending in the second direction, the connection portions connecting the main portion and the held portions, respectively, so that the held portions have outwardly-extending ends, respectively, the outwardly-extending ends of the held portions constituting the engaging portions, respectively, wherein the second insulator has end portions in the second direction and is formed with accommodation portions and through-holes, the accommodation portions opening in the first direction and having inner walls, respectively, the accommodation portions being configured to partially accommodate the connection portions, respectively, the through-holes extending between the inner walls of the accommodation portions and the end portions of the second insulator, respectively, the through-holes holding the held portions, respectively, so that the held portions are rotatable in the through-holes in response to operation of the main portion and are movable in the second direction, wherein the inner walls of the accommodation portions are formed with cam portions, respectively, wherein the engaging portions project outwardly from the end portions of the second insulator when the second lock portion is laid under a normal state, and wherein the connection portions follow the cam portions when the held portions are rotated, so that the cam portions force the engaging portions to move inward of the second insulator.

2. The connector assembly according to claim 1, the first connector being mountable on a circuit board and further comprising fixed portions, the fixed portions being fixed to the circuit board when the first connector is mounted on the circuit board, each of the sidewall portions having a top portion and an outer surface, the fixed portions being connected to the first lock portions at positions above the top portions of the sidewall portions, respectively, the fixed portions covering the outer surfaces of the sidewall portions, respectively.

3. A connector assembly comprising a first connector and a second connector, the first connector being matable with and detachable from the second connector along a first direction, the first connector comprising a first insulator and first lock portions, the first lock portions being made of metal and being attached to the first insulator, each of the first lock portions being formed with an engaged hole, the engaged hole piercing the first lock portion in a second direction perpendicular to the first direction, the second connector comprising a second insulator and a second lock portion, the second lock portion being provided with engaging portions, the second insulator holding the second lock portion while the engaging portions being movable along the second direction, the engaging portions of the second lock portion being positioned within the engaged holes of the first lock portions, respectively, under a mating state of the first connector with the second connector, so that the mating state is locked, wherein the second lock portion has a shape obtainable by bending a single metal rod, the second lock portion comprising a main portion, held portions and connection portions, the main portion extending in the second direction, each of the held portions extending in the second direction, the connection portions connecting the main portion and the held portions, respectively, so that the held portions have outwardly-extending ends, respectively, the outwardly-extending ends of the held portions constituting the engaging portions, respectively, the second insulator having end portions in the second direction, the second insulator being formed with accommodation portions and through-holes, the accommodation portions opening in the first direction and having inner walls, respectively, the accommodation portions being configured to partially accommodate the connection portions, respectively, the through-holes extending between the inner walls of the accommodation portions and the end portions of the second insulator, respectively, the through-holes holding the held portions, respectively, so that the held portions are rotatable in the through-holes in response to operation of the main portion and are movable in the second direction, the inner walls of the accommodation portions being formed with cam portions, respectively, the engaging portions projecting outwardly from the end portions of the second insulator when the second lock portion is laid under a normal state, the connection portions follow the cam portions when the held portions are rotated, so that the cam portions force the engaging portions to move inward of the second insulator.

4. The connector assembly according to claim 3, wherein the first lock portions comprise guide portions, respectively, each of the guide portions being arranged oblique to the first and the second directions so that the guide portions guide the respective engaging portions of the second lock portion when the first connector is mated with the second connector.

5. The connector assembly according to claim 3, further comprising a shell, the shell covering, at least in part, the first insulator, the first lock portions being formed as parts of the shell.

6. The connector assembly according to claim 3, wherein each of the accommodation portions comprises a narrower portion and a wider portion, the narrower portion having a first width in the second direction, the wider portion having a second width wider than the first width in the second direction, the cam portion being positioned between the narrower portion and the wider portion, the cam portions forcing the engaging portions to move inward when the connection portions move from the wider portions to the narrower portions in response to operation of the main portion, each of the held portions having a length larger than the first width but smaller than the second width.

7. A connector, matable with and detachable from another connector along a first direction, the connector comprising:

an insulator formed with accommodation portions, through-holes, and end portions, each accommodation portion opening in the first direction and having an inner wall, and the end portions being in a second direction perpendicular to the first direction; and a lock portion comprising a main portion, held portions, and connection portions, each connection portion connecting the main portion with a respective held portion so that the respective held portion has an outwardly-extending end;

wherein the outwardly-extending ends constitute engaging portions;

wherein the insulator holds the lock portion while the engaging portions are movable along the second direction;

wherein the main portion and each of the held portions extend in the second direction;

wherein each accommodation portion is configured to partially accommodate a respective connection portion;

wherein each through-hole extends between a respective inner wall and a respective end portion;

wherein each through-hole holds a respective held portion, so that the respective held portion is rotatable in the through-hole in response to operation of the main portion and is movable in the second direction;

wherein each inner wall has a cam portion;

wherein each engaging portion projects outwardly from a respective end portion when the lock portion is laid under a normal state; and wherein each connection portion follows a respective cam portion when a respective held portion is rotated, so that the respective cam portion forces a respective engaging portion to move inward of the insulator.

* * * * *